US009988577B2

(12) United States Patent
Zhu

(10) Patent No.: US 9,988,577 B2
(45) Date of Patent: Jun. 5, 2018

(54) SLEEVE-TYPE COAL MATERIAL DECOMPOSITION APPARATUS

(71) Applicant: XIXIA DRAGON INTO SPECIAL MATERIAL CO., LTD., Henan (CN)

(72) Inventor: Shucheng Zhu, Henan (CN)

(73) Assignee: XIXIA DRAGON INTO SPECIAL MATERIAL CO., LTD., Henan (CN)

( * ) Notice: Subject to any disclaimer, the term of this patent is extended or adjusted under 35 U.S.C. 154(b) by 955 days.

(21) Appl. No.: 14/380,041

(22) PCT Filed: Mar. 26, 2013

(86) PCT No.: PCT/CN2013/073158

§ 371 (c)(1),
(2) Date: Oct. 24, 2014

(87) PCT Pub. No.: WO2013/123918

PCT Pub. Date: Aug. 29, 2013

(65) Prior Publication Data

US 2015/0083573 A1 Mar. 26, 2015

(30) Foreign Application Priority Data

Feb. 21, 2012 (CN) ..... 2012 1 0039372

(51) Int. Cl.
*C10B 21/22* (2006.01)
*C10B 53/04* (2006.01)
(Continued)

(52) U.S. Cl.
CPC ..... *C10B 21/22* (2013.01); *C10B 1/04* (2013.01); *C10B 1/06* (2013.01); *C10B 1/08* (2013.01);
(Continued)

(58) Field of Classification Search
CPC .... C10B 1/04; C10B 1/06; C10B 1/08; C10B 19/00; C10B 21/00; C10B 21/08; C10B 21/22; C10B 47/18; C10B 53/04
See application file for complete search history.

(56) References Cited

U.S. PATENT DOCUMENTS 4,563,247 A * 1/1986 Kuerston ..... B01F 11/0082 196/123
5,082,534 A 1/1992 Breu
2013/0134031 A1 5/2013 Zhu et al.

FOREIGN PATENT DOCUMENTS

CN 101985559 A 3/2011
CN 101985562 A 3/2011
(Continued)

OTHER PUBLICATIONS

English machine translation of CN 102154019 A, obtained from Google Aug. 10, 2017.*
(Continued)

*Primary Examiner* — Renee Robinson
(74) *Attorney, Agent, or Firm* — Rossi, Kimms & McDowell LLP

(57) ABSTRACT

The invention discloses a sleeve-type coal material decomposition apparatus which includes a kiln body. The inside of the kiln body is set with coal material decomposition-promoting layers and circular heating layers centered on the axis of kiln body; the circular coal material decomposition-promoting layers and circular heating layers are isolated from each other; both ends of the circular coal material decomposition-promoting layer are respectively connected to the coal inlet and coal outlet on kiln body and are also connected to the decomposition gas collecting mechanism on kiln body. The coal material decomposition-promoting layers and circular heating layers are isolated from each other, which is helpful for the acquisition of pure coal
(Continued)

decomposition gas. The heat released from circular heating layers is fully absorbed by adjacent set coal material decomposition-promoting layers via conduction and radiation forms; the full absorption of pulverized coal brings better effect of complete decomposition.

9 Claims, 3 Drawing Sheets

(51) Int. Cl.

| | |
|---|---|
| ***C10B 47/18*** | (2006.01) |
| ***C10B 1/08*** | (2006.01) |
| ***C10B 1/06*** | (2006.01) |
| ***C10B 1/04*** | (2006.01) |
| ***C10B 21/08*** | (2006.01) |
| ***C10B 19/00*** | (2006.01) |

(52) U.S. Cl.
CPC ..... *C10B 19/00* (2013.01); *C10B 21/08* (2013.01); *C10B 47/18* (2013.01); *C10B 53/04* (2013.01)

(56) References Cited

FOREIGN PATENT DOCUMENTS

| | | | |
|---|---|---|---|
| CN | 201825921 | U | 5/2011 |
| CN | 102154019 | A | 8/2011 |
| CN | 102585863 | A | 7/2012 |
| JP | 2003277761 | A | 10/2003 |

OTHER PUBLICATIONS

International Search Report issued in PCT/CN2013/073158, dated Jul. 4, 2013. English translation provided.

* cited by examiner

SLEEVE-TYPE COAL MATERIAL DECOMPOSITION APPARATUS

FIELD OF THE INVENTION

The present invention relates to the technical field of decomposition apparatus of coal materials including pulverized coal and crushed coal, and specifically, it relates to a sleeve-type coal material decomposition apparatus.

BACKGROUND OF THE INVENTION

In conventional technology, coal is used to produce coal gas, natural gas, or used to produce gas by coking at high temperature, medium temperature or low temperature. However, the said technology is required to form pulverized coal into blocks or sift lump coal, which increases the cost of raw material, or results in the produced gas without a high heat value, a big additional value and significant economic and social benefits. The heating mode of furnace can be classified as external-heating mode, internal-heating mode and hybrid-heating mode. The heating medium in external-heating furnace is not contact directly with raw materials and heat is transferred from furnace wall. The heating medium in the internal-heating furnace contacts with the raw materials directly, and the heating methods are classified as solid heat carrier mode and gas heat carrier mode according to different heat media.

At present, there are two kinds of conventional coal decomposition apparatuses, one of which has an up-draft kiln structure. The up-draft kiln structure is used for combusting flue gas and combustible gases produced by coal, which has low gas purity and a low additional value, as well as partially discharge of gas, which results in a significant resources wasting and environmental pollution. Another kind of coal decomposition apparatus has a shaft kiln structure. In the structure, coal lumps are placed on clapboard with holes, and a heater is provided above the coal lumps. Because the coal lumps on the clapboard are accumulated to a certain thickness, so they cannot be uniformly heated and decomposed, and are required to be cyclically heated and decomposed by the decomposed gas. More importantly, since the presence of large amount of holes for ventilation and circulatory function provided on the clapboard, pulverized coal can leak through the holes. To avoid this, it is necessary to process the pulverized coal into coal briquette when introducing it into the shaft kiln. Thus, it will increase the cost of pulverized coal decomposition, and reduce the economic benefits because the pulverized coal cannot be directly used for coal decomposition in up-draft kiln.

Furthermore, in order to change the said problems, the patent (authorized notice No.: CN 101985562B) named as the horizontal separation equipment with crushed coal, pulverized coal multiple burners discloses a kind of horizontal separation equipment with crushed coal, pulverized coal multiple burners comprising of a transverse rotary kiln, and the said rotary kiln includes a feed inlet and a feed outlet, and multiple closely-spaced burners are set inside the said rotary kiln body in the direction of the kiln; multiple closely-spaced gas intake pipes and their parallel multiple closely-spaced air intake pipes are set correspondingly along one side of the said closely-spaced burners, the said gas intake pipe connected to its corresponding burner, the said closely-spaced air intake pipe connected to its corresponding burner, and multiple closely-spaced radiating pipes are set correspondingly along another side of the said closely-spaced burners, the said multiple closely-spaced burners connected to their corresponding closely-spaced radiating pipes; the said multiple closely-spaced burners are provided with theirs corresponding multiple burners; the said multiple closely-spaced burners, radiating pipes, gas intake pipes, air intake pipes and the inner wall of rotary kiln form the passage to push and separate crushed coal and pulverized coal. The said embodiment is a good solution for the technical problem of adequate heating and rapid decomposition of pulverized coal, but the problem is that a small number of heating pipes fails to meeting the requirement of rapid and large heat conduction, the heating pipes inside the kiln are therefore dense, and the over crowded pipes cause inconvenience for personnel when performing the overhaul and maintenance, in addition, during its operation, it requires for real-time monitoring of temperature and operation of various segments of each pipe, and collection and analysis of a great number of data. When any segment of a certain pipe is in abnormal state, analysis on it shall be made or shut down for maintenance, which fails to meet the continuous and reliable manufacturing and operation and will cause significant economic loss for large-scaled high temperature integrated equipment under continuous operation.

Furthermore, JP2003277761 A 20031002 document discloses the patent with a title of CATALYTIC HEATING CARBONIZATION FURNACE, which intends to solve the problem: "To provide a catalytic heating carbonization furnace that reduces a running cost of the furnace for carbonization treatment of organic wastes". But in this technical embodiment, the catalytic carbonization furnace is provided as a drying part used for the substance carbonization, playing a role of carbonization, and thermal decomposition part used for the carbonization of substances to be processed; firstly, the carbonization furnace uses the hot gas generated from the heating catalytic combustion for the decomposition of organic matters, after which, further decomposition is conducted by using the exhaust heat, and the temperature of organic waste drops as a result of the drying by the heat accumulator to improve the heat energy utilization efficiency. However, such catalytic burning equipment makes it hard for the processing of coal material, and fails to meet the demand for rapid decomposition of pulverized coal and crushed coal, and there are also problems with its security and reliability.

SUMMARY OF THE INVENTION

To solve the above problems present in the above process, an object of the present invention is to provide a sleeve-type coal material decomposition apparatus featured by more sufficient and uniform heat transmission, higher reliability and superior safety performance.

A sleeve-type coal material decomposition apparatus including kiln body is characterized in that: the inside of said kiln body is set with one or multiple circular coal material decomposition-promoting layers and one or multiple circular heating layers centered on the axis of kiln body; the said circular coal material decomposition-promoting layers and circular heating layers are isolated from each other; both ends of the said circular coal material decomposition-promoting layer are respectively connected to the coal inlet and coal outlet on kiln body and are also connected to the decomposition gas collecting mechanism on kiln body.

The said kiln body is a shaft kiln.

The said kiln body is a transverse kiln.

The said kiln body is an inclined kiln.

The said circular coal material decomposition-promoting layers and circular heating layers are in multilayer alternating arrangement. The preferred number of the said circular coal material decomposition-promoting layers and circular heating layers is respectively two or more, such as 2, 3, 4, 5 or more.

The said circular heating layers are electrical heating layers the inside of which is provided with the electrothermal component connected to power source.

The said circular heating layers are high-temperature gas heating layers which are respectively connected to high-temperature gas inlet pipe and heating gas outlet pipe.

The said circular coal material decomposition-promoting layers are connected to coal inlet by material distributing cabinet and to coal outlet by material collecting cabinet.

The inside of said circular coal material decomposition-promoting layers is installed with feed mechanism.

The said multiple circular coal material decomposition-promoting layers are connected with each other by pipeline.

Thanks to the arrangement of coal material decomposition-promoting layers and circular heating layers centered on the axis of kiln body inside the kiln body, the said coal material decomposition-promoting layers and circular heating layers are isolated from each other, which is helpful for the acquisition of pure coal decomposition gas and provides favorable technical support for further decontamination, purification and liquidation; in addition, the alternating arrangement of coal material decomposition-promoting layers and circular heating layers allows the coal material decomposition-promoting layers and circular heating layers to be in contact with and close to each other, which enables the heat released from circular heating layers to be fully absorbed by adjacent set coal material decomposition-promoting layers via conduction and radiation forms; the full absorption of pulverized coal improves the efficiency of heat absorption, brings better effect of complete decomposition and generates fuel gas, tar gas and coal with higher heat value in coal material decomposition-promoting layers. What's more, it changes the status quo of dense arrays of heating pipes inside the kiln body so as to bring convenience to workers for maintenance, and further enhance the reliability and stability; besides, in the working process, real-time monitoring of the temperature and running condition of each section of each pipe will be not necessary, thereby there will be less data to be grasped and analyzed and the operating stability and accuracy will be higher; for the large high-temperature integrated equipments in continuous operation, stability and reliability mean great economic benefits. The said multiple coal material decomposition-promoting layers are connected with each other by breather pipe, which makes it easier to collect the coal decomposition gas generated in each circular layer together via the center or the circular layer close to center; the structure for collecting decomposition gas is quite simple and reliable. Such circles-within-circles structure in annual ring form disclosed by the present invention makes the decomposition and separation of the pulverized and crushed coal more fast and efficient so as to save and fully utilize energy and greatly increase the utilization rate and level of coal resources, thus it will produce a significant economic and social benefits for the entire society.

BRIEF DESCRIPTION OF THE DRAWINGS

The accompanying drawings facilitate an understanding of the various embodiments of this invention, in which.

DETAILED DESCRIPTION OF THE INVENTION

Embodiment 1

Figure 1:
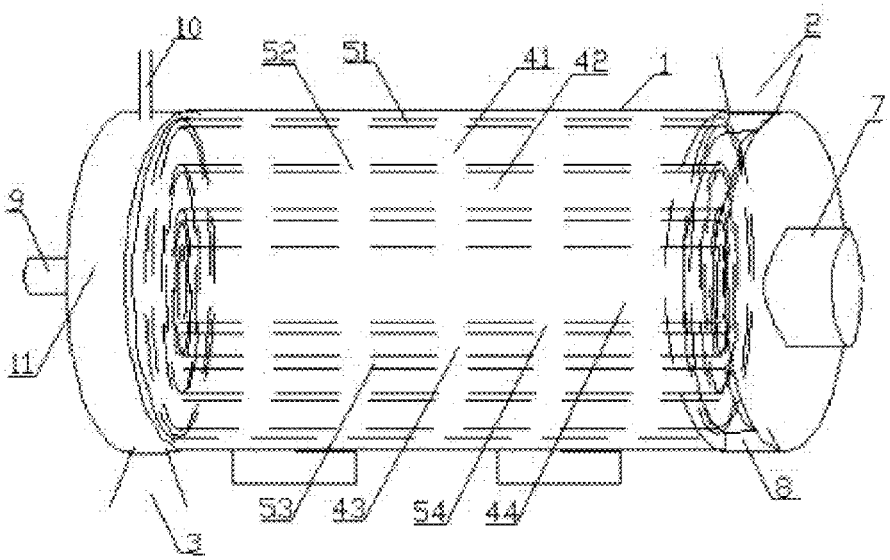
FIG. 1 is a structure diagram according to Embodiment 1 of the present invention.
Figure 2:
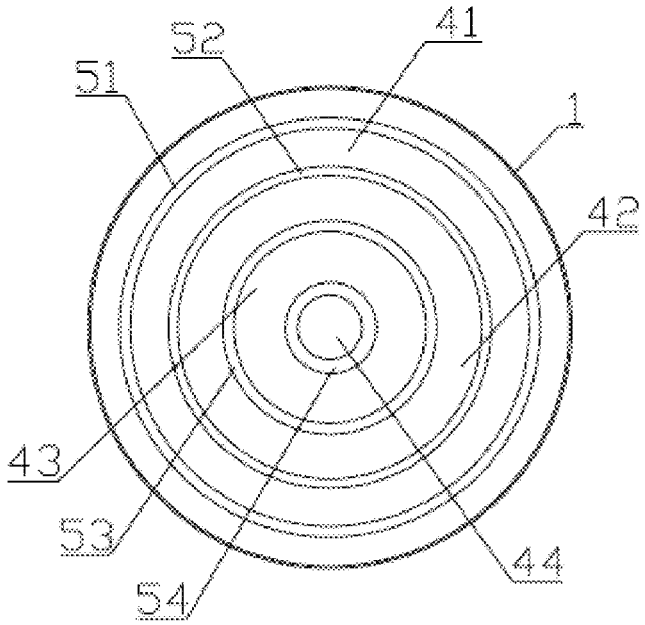
FIG. 2 is a structure diagram showing the circular coal material decomposition-promoting layers and circular heating layers of the present invention.

As shown in FIG. 1 and FIG. 2: A sleeve-type coal material decomposition apparatus, including kiln body 1: the inside of said kiln body 1 is set with circular coal material decomposition-promoting layers and circular heating layers centered on the axis of kiln body 1; the said circular coal material decomposition-promoting layers and circular heating layers are isolated from each other; both ends of the said circular coal material decomposition-promoting layer are respectively connected to the coal inlet 2 and coal outlet 3 on kiln body 1 and are also connected to the decomposition gas collecting mechanism 10 on kiln body 1. The said kiln body 1 is a transverse kiln. The said circular coal material decomposition-promoting layers and circular heating layers are in multilayer alternating arrangement; No. 1 circular coal material decomposition-promoting layer 41 is adjacent to No. 1 circular heating layer 51 and to No. 2 circular hearing layer 52; No. 2 circular hearing layer 52 is adjacent to No. 2 circular coal material decomposition-promoting layer 42; No. 2 circular coal material decomposition-promoting layer 42 is adjacent to No. 3 circular heating layer 53; No. 3 circular hearing layer 53 is adjacent to No. 3 circular coal material decomposition-promoting layer 43; No. 3 circular coal material decomposition-promoting layer 43 is adjacent to No. 4 circular heating layer 54; No. 4 circular hearing layer 54 is adjacent to No. 4 circular coal material decomposition-promoting layer 44. The said circular heating layers are high-temperature gas heating layers which are respectively connected to high-temperature gas inlet pipe 7 and heating gas outlet pipe 9. The said circular coal material decomposition-promoting layers are connected to coal inlet 2 by material distributing cabinet 8 and to coal outlet 3 by material collecting cabinet 11.

Embodiment 2

Figure 3:
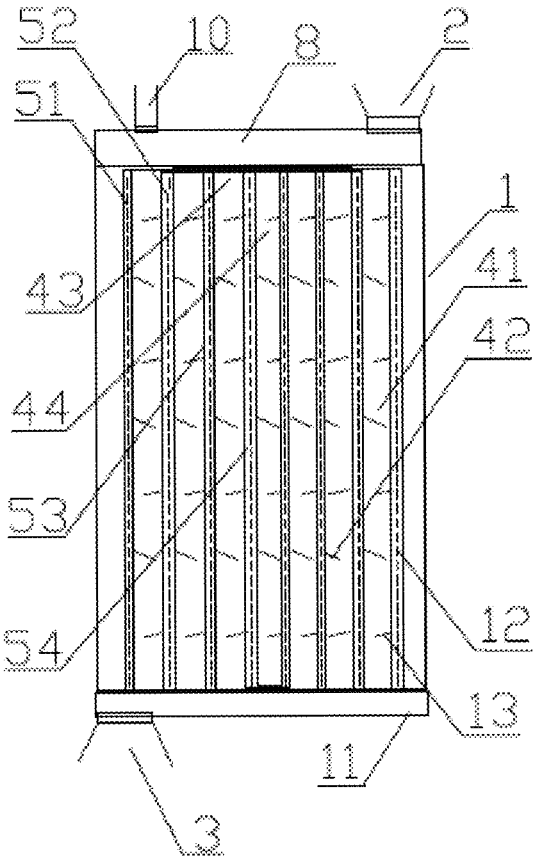
FIG. 3 is a structure diagram according to Embodiment 2 of the present invention.

As shown in FIG. 3: A sleeve-type coal material decomposition apparatus, including kiln body 1: the inside of said kiln body 1 is set with circular coal material decomposition-promoting layers and circular heating layers centered on the axis of kiln body 1; the said circular coal material decomposition-promoting layers and circular heating layers are isolated from each other; both ends of the said circular coal material decomposition-promoting layer are respectively connected to the coal inlet 2 and coal outlet 3 on kiln body and are also connected to the decomposition gas collecting mechanism 10 on kiln body 1. The said kiln body 1 is a shaft kiln. The said circular coal material decomposition-promoting layers and circular heating layers are in multilayer alternating arrangement; No. 1 circular coal material decomposition-promoting layer 41 is adjacent to No. 1 circular heating layer 51 and to No. 2 circular hearing layer 52; No. 2 circular hearing layer 52 is adjacent to No. 2 circular coal material decomposition-promoting layer 42; No. 2 circular coal material decomposition-promoting layer 42 is adjacent to No. 3 circular heating layer 53; No. 3 circular hearing layer 53 is adjacent to No. 3 circular coal material decomposition-promoting layer 43; No. 3 circular coal material decomposition-promoting layer 43 is adjacent to No. 4 circular heating layer 54; No. 4 circular hearing layer 54 is adjacent to No. 4 circular coal material decomposition-promoting layer 44. The said circular heating layers are electrical heating layers the inside of which is provided with the electrothermal component connected to power source. The said circular coal material decomposition-promoting layers are connected to coal inlet 2 by material distributing cabinet 8 and to coal outlet 3 by material collecting cabinet 11. The inside of said circular coal material decomposition-promoting layers is installed with feed mechanism 13.

Embodiment 3

Figure 4:
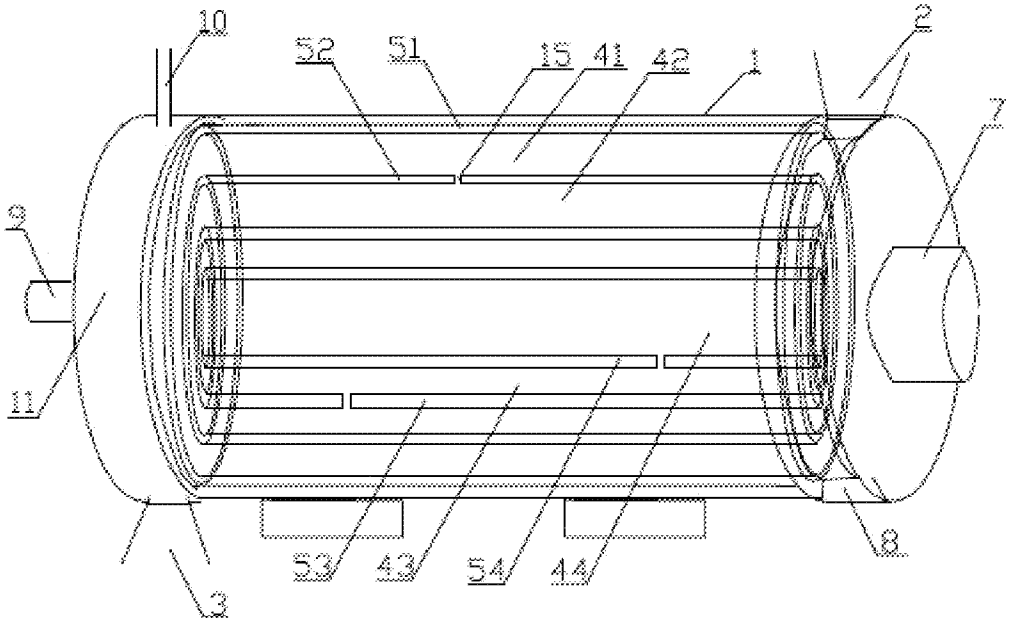
FIG. 4 is a structure diagram according to Embodiment 2 of the present invention.

As shown in FIG. 2 and FIG. 4: A sleeve-type coal material decomposition apparatus, including kiln body 1: the inside of said kiln body 1 is set with circular coal material decomposition-promoting layers and circular heating layers centered on the axis of kiln body 1; the said circular coal material decomposition-promoting layers and circular heating layers are isolated from each other; both ends of the said circular coal material decomposition-promoting layer are respectively connected to the coal inlet 2 and coal outlet 3 on kiln body 1 and are also connected to the decomposition gas collecting mechanism 10 on kiln body 1. The said kiln body 1 is a transverse kiln. The said circular coal material decomposition-promoting layers and circular heating layers are in multilayer alternating arrangement; No. 1 circular coal material decomposition-promoting layer 41 is adjacent to No. 1 circular heating layer 51 and to No. 2 circular hearing layer 52; No. 2 circular hearing layer 52 is adjacent to No. 2 circular coal material decomposition-promoting layer 42; No. 2 circular coal material decomposition-promoting layer 42 is adjacent to No. 3 circular heating layer 53; No. 3 circular hearing layer 53 is adjacent to No. 3 circular coal material decomposition-promoting layer 43; No. 3 circular coal material decomposition-promoting layer 43 is adjacent to No. 4 circular heating layer 54; No. 4 circular hearing layer 54 is adjacent to No. 4 circular coal material decomposition-promoting layer 44. The said circular heating layers are high-temperature gas heating layers which are respectively connected to high-temperature gas inlet pipe 7 and heating gas outlet pipe 9. The said circular coal material decomposition-promoting layers are connected to coal inlet 2 by material distributing cabinet 8 and to coal outlet 3 by material collecting cabinet 11. The said multiple coal material decomposition-promoting layers are connected with each other by breather pipe 15, which makes it easier to collect the coal decomposition gas generated in each circular layer together via the center or the circular layer close to center; the structure for collecting decomposition gas is quite simple and reliable.

What is claimed is:

1. A sleeve-type coal material decomposition apparatus including:

a kiln body having an inner wall, a first end, and a second end;

a coal inlet disposed at the first end of the kiln body;

a coal outlet and a decomposition gas outlet disposed at the second end of the kiln body;

a plurality of heating chambers formed of heat conduction material and disposed inside the kiln body in layers centered on the axis of the kiln body such that first ends of the plurality of heating chambers are disposed at the first end of the kiln body and second ends of the plurality of heating chambers are disposed at the second end of the kiln body; and a plurality of coal material passages respectively disposed between the plurality of heating chambers, first ends of the plurality of coal material passages being connected to the coal inlet and second ends of the plurality of coal material passages being connected to the coal outlet and the decomposition gas outlet, wherein at least two heating chambers and at least two coal material passages are disposed inside the kiln body, and a gap is disposed between an outermost heating chamber of the plurality of heating chambers and the inner wall of kiln body.

2. The sleeve-type coal material decomposition apparatus according to claim 1, wherein the kiln body is a shaft kiln.

3. The sleeve-type coal material decomposition apparatus according to claim 1, wherein the kiln body is a transverse kiln.

4. The sleeve-type coal material decomposition apparatus according to claim 1, wherein the kiln body is an inclined kiln.

5. The sleeve-type coal material decomposition apparatus according to claim 1, wherein each of the plurality of heating chambers includes an electrothermal element configured to be connected to a power source.

6. The sleeve-type coal material decomposition apparatus according to claim 1, further including a heating gas inlet disposed at the first end of the kiln body and a heating gas outlet disposed at the second end of the kiln body, wherein the first ends of the plurality of heating chambers are connected to the heating gas inlet, and the second ends of the plurality of heating chambers are connected to the heating gas outlet.

7. The sleeve-type coal material decomposition apparatus according to claim 1, further including a coal material distributing cabinet and a coal material collecting cabinet, wherein the first ends of the plurality of coal material passages are connected to the coal inlet by the coal material distributing cabinet, and the second ends of the plurality of coal material passages are connected to the coal outlet by the coal material collecting cabinet.

8. The sleeve-type coal material decomposition apparatus according to claim 1, further including a feed mechanism disposed in each of the plurality of coal material passages.

9. The sleeve-type coal material decomposition apparatus according to claim 1, wherein the plurality of coal material passages are connected with each other.

* * * * *